United States Patent [19]

Ladd, Jr. et al.

[11] Patent Number: 4,647,240

[45] Date of Patent: Mar. 3, 1987

[54] COSMETIC POWDER DISPENSER AND APPLICATOR

[75] Inventors: James E. Ladd, Jr., Rowayton; David R. Jacobs, Norwalk, both of Conn.

[73] Assignee: Laura Lupton, Inc., Rowayton, Conn.

[21] Appl. No.: 811,336

[22] Filed: Dec. 20, 1985

Related U.S. Application Data

[63] Continuation-in-part of Ser. No. 752,133, Jul. 5, 1985.

[51] Int. Cl.[4] ..... A46B 11/00; A46B 11/04

[52] U.S. Cl. ..... 401/123; 132/81; 401/125; 401/280; 401/281

[58] Field of Search ..... 401/123, 125, 280, 281; 132/81

[56] References Cited

U.S. PATENT DOCUMENTS

| | | | |
|---|---|---|---|
| 1,121,788 | 12/1914 | Bongiovanni | 401/281 |
| 1,183,680 | 5/1916 | Sauer, Jr. | 401/280 X |
| 1,588,633 | 6/1926 | Taylor | 401/123 X |
| 1,716,739 | 6/1929 | Russel | 401/281 |
| 1,773,820 | 8/1930 | Lysons | 401/280 X |
| 2,480,331 | 8/1949 | Lecker | 401/125 |

*Primary Examiner*—Steven A. Bratlie

[57] ABSTRACT

A first elongated hollow cylindrical member has a first open end and a second closed end. The second end has a central opening and an exposed face carrying an offset circular groove surrounding the opening. A hollow elongated capsule filled with cosmetic powder is slidably and removably disposed in the first member and has an open end adjacent the second end. A second elongated hollow cylindrical member has a third closed end and an opposite open fourth end. The third end has an exposed face with a transverse slot therein. The slot has a hole. The second and third ends are rotatably engaged. An elongated member is slidable in the slot and has a chamber and a transversely disposed prong. The prong rides in the groove and is moved back and forth in the slot as the first and second members are rotated relatively to each other. These members have a first rotational position at which the chamber and opening are aligned and a second rotational position at which the hole and opening are aligned. A brush carrying third member is engaged at its brush carrying end to the fourth end.

5 Claims, 9 Drawing Figures

COSMETIC POWDER DISPENSER AND APPLICATOR

CROSS REFERENCE TO COPENDING APPLICATION

This application is a continuation-in-part of copending application entitled "Cosmetic Powder Dispenser and Applicator", filed July 5, 1985, Ser. No. 752,133 now issued.

BACKGROUND OF THE INVENTION

The copending application Ser. No. 752,133 discloses a cosmetic powder dispenser and applicator in which first and second members have a first position of relative rotation at which openings in the two members are aligned and powder can flow through the aligned openings onto a brush for application by the user. These members have a second position of relative rotation at which this powder flow is blocked. The present invention is directed to this type of powder dispenser and applicator wherein a combination of rotational and transverse motions are employed to produce control of powder flow.

SUMMARY OF THE INVENTION

In accordance with the principles of the invention, a cosmetic powder dispenser and applicator employs a first elongated hollow member having first and second opposite ends. The first end is open. The second end is closed except for a centrally disposed opening therein. The second end has an exposed face with a circular groove therein which encloses the central opening and is spaced therefrom. The center of the groove is offset from the center of the opening.

An elongated capsule adapted to be filled with cosmetic powder is closed at one end and is open at the other. The capsule is removably slidable into and out of the first member. The capsule, when inserted in the first member, has its open end adjacent the second end of the first member and its closed end closing the first end of the first member.

A second elongated hollow member has a third closed end with an exposed face and an opposite open fourth end. The third end has a slot in its exposed face which extends transversely across this face. The slot has a hole therein communicating with the interior of the second member. The second end of the first member rotatably engages the third end of the second member.

An elongated element is disposed slidably in the slot. The element has a transversely extending prong and a chamber offset from the prong. The prong engages the circular groove whereby manual rotation of one of the first and second members with respect to the other causes the element to move back and forth in the slot. These two members have a first position of relative rotation at which the central opening is aligned with the chamber and have a second position of relative position at which the hole is aligned with the chamber.

A third elongated hollow member has an open end in which a brush having bristles is inserted. The brush and third member have manually operated cooperating elements for establishing a forward position at which the bristles extend almost entirely out of the third member and a second withdrawn position at which the brush is disposed within the third member. The brush carrying end of the third member is disposed removably in the fourth end of the second member.

In use, the three members are disposed end to end and the dispenser and applicator is disposed vertically with the first member disposed above the third member, the brush being in withdrawn position in the third member. The first and second members are then placed into the first position of relative rotation whereby powder flows through the central opening into the chamber. The first and second members are then placed into the second position of relative rotation whereby the powder in the chamber flows out of the chamber and through the hole onto the brush. The third member can then be detached and the brush moved into the forward position to expose the bristles. By using the third member as a handle, the user can apply the powder as needed.

The chamber thus serves not only as a conduit for carrying the powder but also provides a metering function to regulate the amount of powder discharged onto the bristles, since this amount is determined by the powder receiving capacity of the chamber.

DETAILED DESCRIPTION OF PREFERRED EMBODIMENTS

Figures 1, 2, 3, 4A, 4B, 5A, 5B, 6A, 6B:
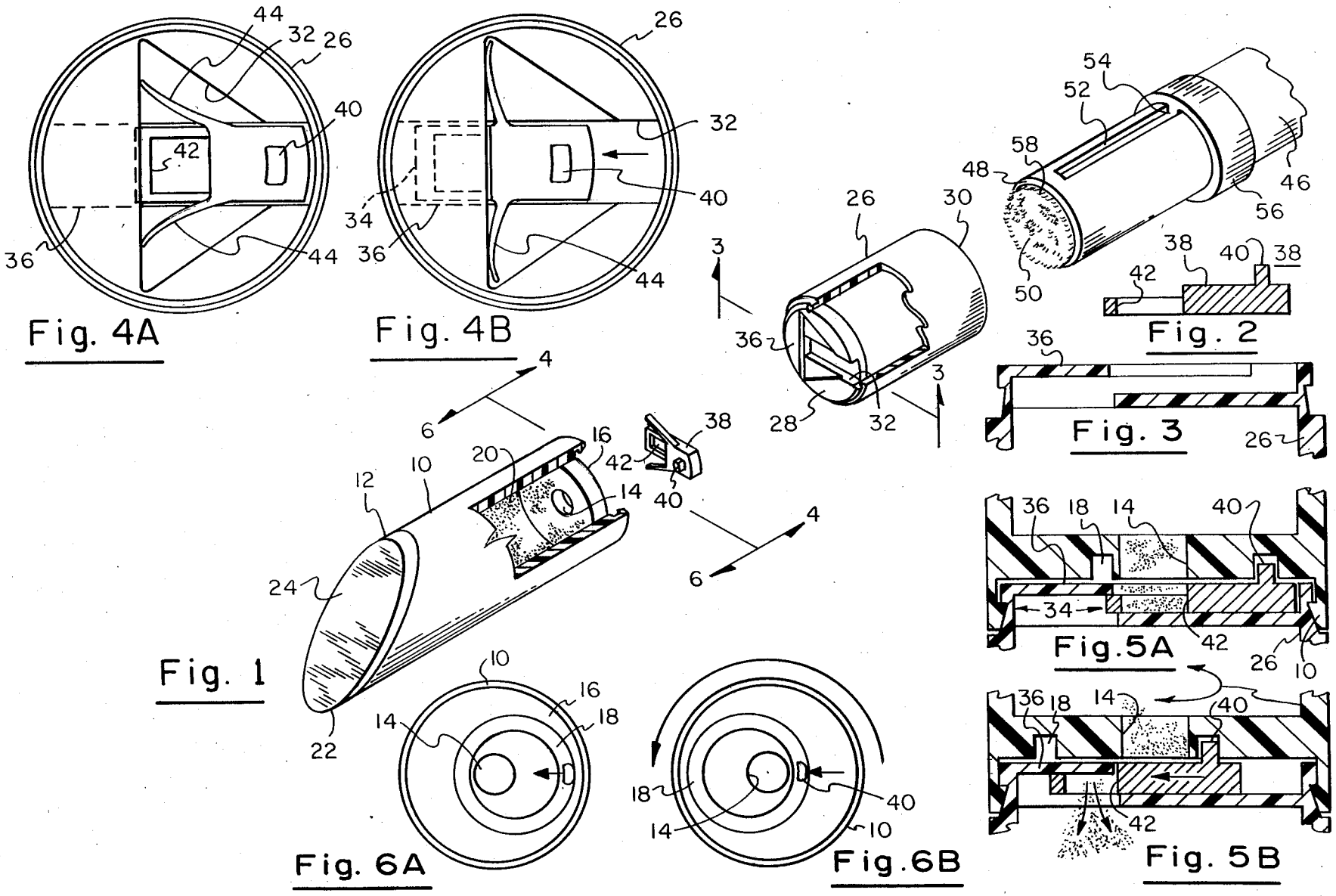
FIG. 1 is an exploded view illustrating one embodiment of the invention.
FIG. 2 is a longitudinal cross section of one of the components of FIG. 1.
FIG. 3 is a view in cross section of the slot carrying face of the second member shown in FIG. 1.
FIGS. 4A and 4B are enlarged views showing the position of the element of FIG. 1 in the slot carrying face of the second member when the first and second members are respectively in the first or second positions of relative rotation.
FIGS. 5A and 5B are cross sectional views illustrating the powder feeding action when the first and second members are respectively in the first or second positions of relative rotation.
FIGS. 6A and 6B are detail views of the circular groove and interconnected prong when the first and second members are respectively in the first or second positions of relative rotation.

Referring to FIGS. 1–6, a first elongated hollow cylindrical plastic member 10 has one open end 12 which lies in a plane disposed at an acute angle with respect to the direction of elongation and has the shape of an ellipse. The opposite end 16 of member 10 is closed. End 16 has a circular periphery and has a small centrally disposed circular opening 14. The exposed face of end 16 has a circular groove 18 surrounding and spaced from opening 14. The center of the groove is offset from the center of opening 14.

A hollow elongated plastic capsule 22 can be filled with cosmetic powder 20 and slidably and removably inserted into member 10 via its open end. The capsule has a closed transparent end 24 which meets the open end of member 10 in flush engagement. The opposite end of the capsule is open and abuts the opposite closed end of member 10. Since end 24 is transparent, the user can determine visually how much powder remains to be used.

A second hollow elongated cylindrical member 26 has a closed end 28 and an opposite open end 30. End 28 has an exposed face with a transverse slot 32. Slot 32 has a hole 34 therein. The hole is covered by a solid section 36 of the face. An elongated element 38 is slidably disposed in the slot. The element has adjacent one end a transverse prong 40 and adjacent the other end an opening designated as a chamber 42. The element is slidable in the slot and has two oppositely disposed arms 44 in the form of leaf springs which engage enlarged regions of the slot.

The members 10 and 26 are rotatably engaged with a lip in end 16 snap fitting rotatably in an outer groove in end 28. Prong 40 engages and rides in circular groove 18. Members 10 and 26 have a first position of relative rotation, as shown in FIGS. 4A, 5A and 6A, wherein the chamber is in registration with opening 14 and the lower end of the chamber is closed by the adjacent surface of the slot. These members have a second position of relative rotation, as shown in FIGS. 4B, 5B, and 6B, wherein the chamber is in registration with hole 34 and the upper end of the chamber is closed by section 36.

When the dispenser and applicator is in use, it should be apparent that powder can flow out of the capsule and the central opening into the chamber to fill it when the members 10 and 26 are in the first position of relative rotation and that powder can flow out of the chamber and through the hole when these members are in the second position of relative rotation. It should also be apparent that the powder charge in the chamber is determined by the capacity of the chamber.

A third hollow elongated plastic member 46 has one open end 48 and an opposite closed end. A brush 58 with substantially parallel bristles 50 is slidably disposed in the open end 48 of member 46. That portion of member 46 adjacent end 48 has two oppositely disposed longitudinally extending slots 52, only one of which is visible in the drawing.

The outer surface of the brush has two oppositely disposed elongated runners 54, each runner riding in a corresponding slot 52. The runners are secured at one end to ring 56 which is also the base for the bristles.

The brush can be slid forward so that the bristles are almost entirely exposed, or can be withdrawn so that the brush is disposed within the third member. The positions of the slots and runners are such that the brush is always secured to member 44 which can act as a brush handle.

The three members all have a common longitudinal axis. When the dispenser and applicator is disposed vertically, a charge of powder can be transferred from the capsule onto the bristles for use as previously described.

What is claimed is:

1. A cosmetic powder dispenser and applicator comprising:

a first elongated hollow cylindrical member having a first open end and an opposite closed second end, said second end having a centrally disposed opening and an exposed face, the face carrying a circular groove offset from the center of the opening and surrounding it;

a hollow elongated capsule, adapted to be filled with cosmetic powder, closed at one end and open at the other and removably slidable into and out of the first member, the capsule, when inserted in the first member, having its open end adjacent the second end of the first member and its closed end closing the first end of the first member;

a second elongated hollow cylindrical member having a third closed end and an opposite open fourth end, said third end having an exposed face with a transverse slot, the slot having a hole therein, the second end of the first member rotatably engaging the third end of the second member;

an elongated element disposed slidably in the slot, said element having a chamber and a transversely extending prong which engages the circular groove, whereby relative rotation of the first and second members causes the element to move back and forth in the slot, the first and second members having a first relative position of rotation at which the central opening in the second end is aligned with the chamber and having a second relative position of rotation at which the hole is aligned with the chamber;

a third elongated hollow member having an open fifth end; and a brush having a plurality of essentially parallel bristles with powder applying tips, the brush being slidably disposed in the third member, the fifth end of the third member being removably disposed in the fourth end of the second member.

2. The dispenser and applicator of claim 1 wherein the chamber has open upper and lower ends, the end of the chamber disposed adjacent the central opening being open and the opposite end being closed when the members are in said first position, the end of the chamber disposed adjacent the hole being open and the opposite end being closed when the members are in the second position.

3. The dispenser and applicator of claim 2 wherein the prong is disposed adjacent one end of the element and the chamber is disposed adjacent the other end of the element.

4. The dispenser and applicator of claim 3 wherein when the members are in the first position, the said opposite end of the chamber is closed by the adjacent surface of the slot, and when the members are in the second position, the said opposite end of the chamber is closed by a solid section of the third end.

5. The dispenser and applicator of claim 4 wherein the element has oppositely disposed arms in the form of leaf springs which engage enlarged portions of the slot.

* * * * *